US008662201B1

(12) United States Patent
Wright, Jr. et al.

(10) Patent No.: US 8,662,201 B1
(45) Date of Patent: Mar. 4, 2014

(54) END LOADED BEACON HOUSING WITH A SIDE ACCESS DOOR

(75) Inventors: Ronald F. Wright, Jr., Weatherford, TX (US); David G. Bullock, Weatherford, TX (US)

(73) Assignee: Radius HDD Direct, LLC, Perry, OK (US)

( * ) Notice: Subject to any disclaimer, the term of this patent is extended or adjusted under 35 U.S.C. 154(b) by 401 days.

(21) Appl. No.: 13/085,220

(22) Filed: Apr. 12, 2011

Related U.S. Application Data

(60) Provisional application No. 61/323,347, filed on Apr. 12, 2010.

(51) Int. Cl.
*E21B 25/16* (2006.01)

(52) U.S. Cl.
USPC ..... 175/45; 175/61; 175/73

(58) Field of Classification Search
USPC ..... 175/45, 61, 73, 76
See application file for complete search history.

(56) References Cited

U.S. PATENT DOCUMENTS

| | | | | |
|---|---|---|---|---|
| 6,349,778 | B1 * | 2/2002 | Blair et al. | 175/73 |
| 6,581,690 | B2 * | 6/2003 | Van Drentham-Susman et al. | 166/298 |
| 2002/0043408 | A1 * | 4/2002 | Wentworth et al. | 175/398 |
| 2012/0265686 | A1 * | 10/2012 | Sandstrom et al. | 705/44 |

* cited by examiner

*Primary Examiner* — William P Neuder
(74) *Attorney, Agent, or Firm* — Tomlinson Rust McKinstry Grable

(57) ABSTRACT

An assembly for housing a beacon comprising a number of tools for tracking and locating a drill bit. The assembly is for use as part of a drill string for horizontal directional drilling applications. The housing allows the beacon to be loaded at an end, and provides a side window at an opposite end for viewing the orientation of the beacon within the housing. The housing comprises a locating tab for pairing with a locating slot of the beacon to provide proper orientation. The window has a removable cover to secure the beacon when the access window is not needed for inspection of the beacon.

16 Claims, 5 Drawing Sheets

END LOADED BEACON HOUSING WITH A SIDE ACCESS DOOR

CROSS REFERENCE TO RELATED APPLICATIONS

This application claims priority of U.S. Provisional Patent Application No. 61/323,347, filed Apr. 12, 2010, the contents of which are incorporated fully herein by reference.

FIELD OF THE INVENTION

The present invention relates in general to beacon housings, and in particular to an end loaded beacon housing for use in horizontal directional drilling for installing underground utilities.

BACKGROUND OF THE INVENTION

Horizontal directional drilling is a method of boring horizontally underground for the use of utility installations and remediation. Horizontal directional drilling boring rigs are used to drill a bore without the use of trenches. These boring rigs consist of a boring machine, drill pipe or drill string, and a boring head attached to the front of the drill string. Locating electronics or other instruments are placed within a housing near the boring head. In operation, a bore path is plotted and laid out for the drill string to follow. A beacon such as a transmitter provides a locating signal for detecting the underground position of the boring head. After the boring head has successfully followed a path under the obstacle and continued to bore to a desired length, the boring head can be removed and the utility installed by towing it into the ground behind a backreamer.

The housing is located between the boring head and the drill string and supports the beacon. There are generally three types of beacon housing designs: end loaded, side loaded, and partial opening side loaded. In an end load beacon housing, the beacon is loaded from one end of the housing and mates with a clocking mechanism located within a cavity of the housing. The clocking mechanism orients the beacon within the cavity in the proper position of rotation and secures the beacon in the housing. The problem with end load housing is that the process of installing the beacon and securing it to the clocking mechanism is done blindly, making it difficult to ensure the beacon correctly mates with the clocking mechanism. Another problem often encountered is removing the beacon from the end loaded housing. Epoxy is typically used to fill the transmission slots to keep debris and fluid out of the beacon housing and away from the beacon. The epoxy may eventually breakdown and crack allowing sand and debris to enter the housing and pack around the beacon. When this occurs it can become difficult to remove the beacon from the housing.

Side load beacon housing allow the beacon to be installed through an opening on the side of the housing that is the same length and width as the beacon. The beacon may be inserted parallel with the housing and indexed to the clocking mechanism such that the beacon may properly record and transmit the orientation of the boring head and deliver proper signals. While the side load housing allows the transmitter beacon to more easily be installed in the housing, the problem exists that the door covering the side opening may deteriorate and dislodge from the housing. When this occurs, the beacon becomes exposed and often falls out of the housing becoming damaged beyond repair. The other problem with the side load housings are that they only allow for one or two water ports to direct fluid from the back of the housing to the front, making it hard to use side load housings with larger boring machines.

A partial opening side load housing, described in U.S. Pat. No. 7,600,582, is a side load design but with an opening with a length less than the length of the transmitter. This design reduces the risk of losing the transmitter beacon if the side load door dislodges from the housing. However, drillers that want to bore longer and deeper typically prefer the more durable end load housing mechanisms.

SUMMARY OF THE INVENTION

The invention is directed to a system for drilling a borehole. The system comprises a rotary drill, a drill string, and a housing. The drill string is operatively connected to the rotary drill. The housing is connected at a downhole end of the drill string. The housing comprises a tubular body with a cavity, a first end, a second end, and a window. The first end of the housing defines an opening for loading the beacon into the cavity. The window allows access to the beacon from an exterior of the housing when the beacon is within the cavity.

The invention is further directed to a method of drilling a horizontal borehole using a drill string, a beacon and a drill bit. The method comprises providing a housing to a downhole end of the drill string. The housing has a cavity. The cavity has a first end and a second end. The method further comprises inserting the beacon into the cavity, abutting the beacon with the second end of the cavity and visually verifying that the beacon has a desired orientation relative to the housing through the window.

The invention is further directed to a beacon housing. The beacon housing comprises an open first end, a closed second end, a cavity, a window, a removable window cover, and a removable end plug. The cavity supports a beacon therein. The window is formed in the housing and has an axial length less than a length of the beacon. The window is disposed proximate the second end of the housing. The end plug closes the open first end.

BRIEF DESCRIPTION OF THE DRAWINGS

FIG. 5 is a cutaway side view of the second end of the housing shown in FIG. 3.

DETAILED DESCRIPTION OF THE INVENTION

Figure 1:
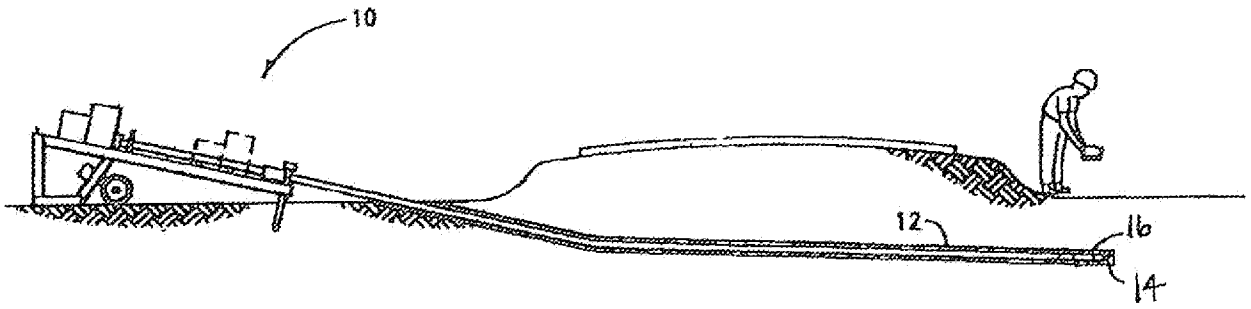
FIG. 1 is a side view of an HDD system and machine for use with the present invention.
Figure 2:
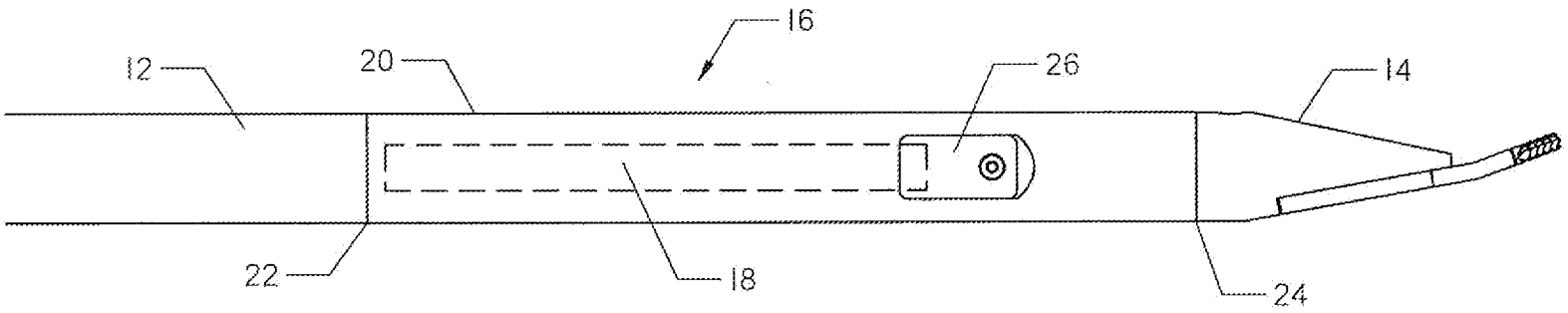
FIG. 2 is a top view of a housing and drill bit for use with the present invention with a beacon shown in phantom.

Turning now to the drawings in general and FIG. 1 specifically, shown therein is a drilling system 10 comprising a drill string 12 having a drill bit 14 and a downhole tool assembly 16. The drill bit 14 is advanced by thrust and/or rotation applied by and through the drill string 12 by a rotary drill or other mechanism at a drilling machine. As shown with more detail in FIG. 2, the downhole tool assembly 16 comprises one or more beacons 18 and a housing 20 for connection to the drill string 12 and protection of components of the beacon 18. The beacon 18 may comprise one or more of many known sensors, transmitters or beacons, as well as on-board instruments such as batteries, rotation sensors, etc. The beacon 18 is shown within the housing 20. The housing comprises a first end 22, a second end 24, and an access window 26.

Figure 3:
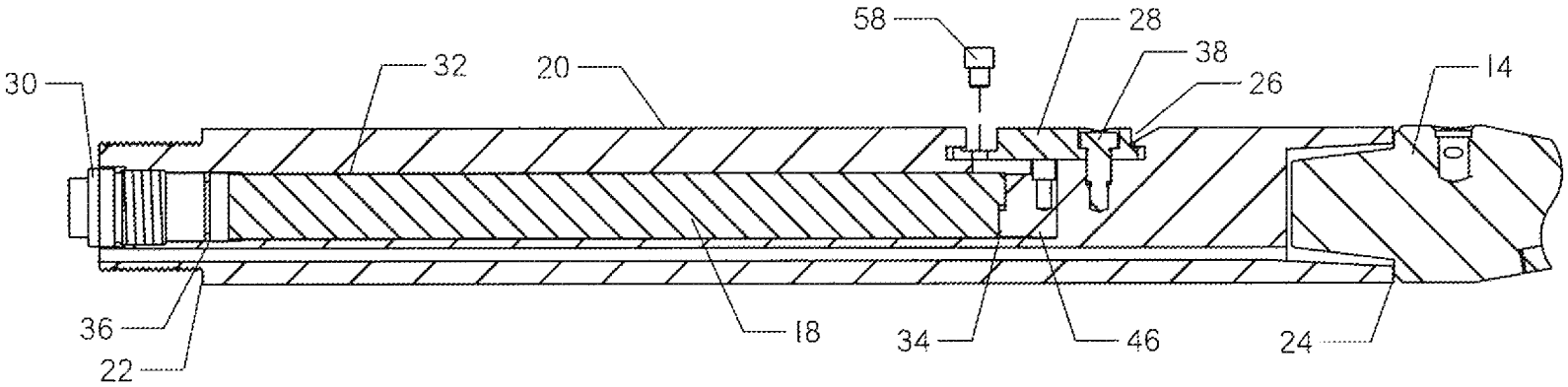
FIG. 3 is a cutaway side view of a housing of the present invention containing a beacon.

With reference now to FIG. 3, the housing 20 further comprises a removable cover 28 covering the window 26, and an end plug 30. The housing 20 is preferably cylindrical and hollow with an elongated cavity 32, and the access window 26 is located on a side wall of the housing allowing visual access to the cavity 32. The beacon 18 may comprise a locating slot 34. The slot 34 is preferably located proximate the second end 24 when the beacon 18 is located within the cavity 32. The first end 22 defines an opening 36. The beacon 18 is receivable within the opening 36. The plug 30 is located at the first end 22 and adapted to cover the opening 36 of the first end. The end plug 30 is secured in the first end of the housing 20 to seal the opening 36. Bolts 38 are provided to secure the cover 28 to the housing 20 and over the window 26.

Figure 4:
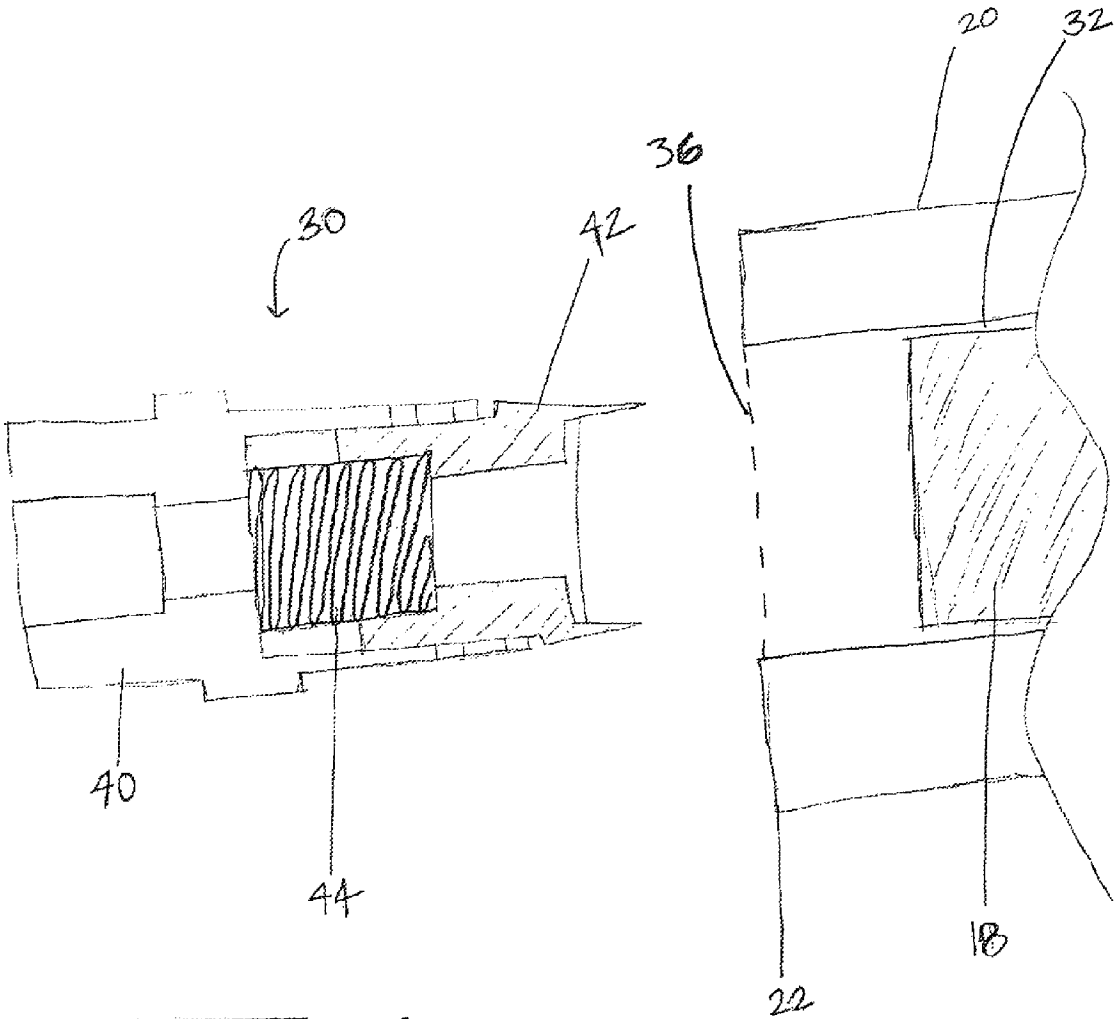
FIG. 4 is a cutaway side view of an end plug for use at the first end of the housing shown in FIG. 3.
Figure 3:
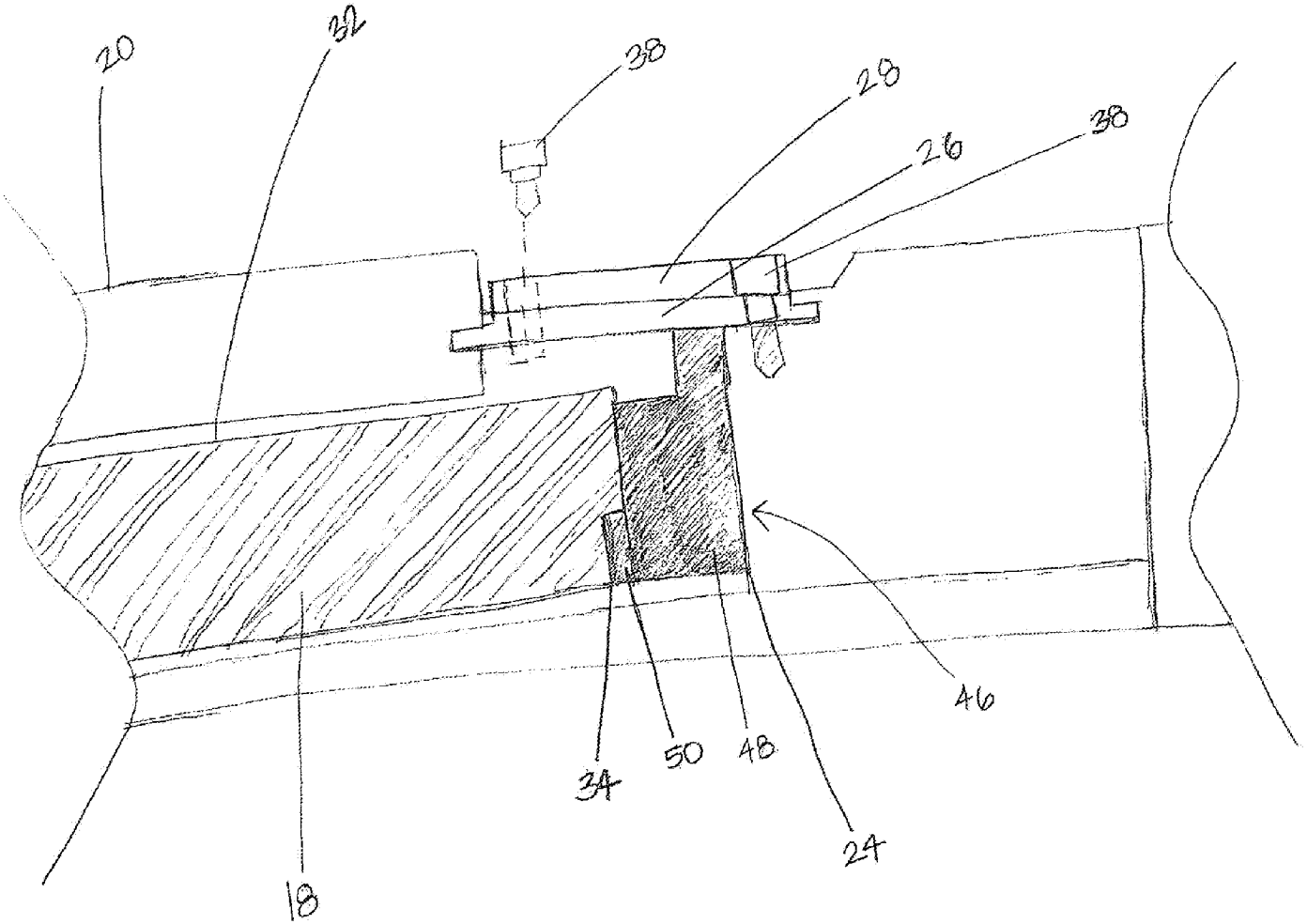

With reference now to FIG. 4, the end plug 30 comprises a plug housing 40, a bracket 42 and a spring 44. The plug housing 40 is engageable at the first end 22 of the housing 20 to cover the opening 36. The spring 44 biases the bracket 42 to move away from the plug housing 40. The bracket 42 is engageable to the beacon 18 and thus biases the beacon toward the second end 24 (FIG. 2) of the cavity 32.

With reference now to FIG. 5, the second end 24 comprises a clocking assembly 46. The clocking assembly 46 comprises a block 48 and a tab 50. The tab 50 is affixed to and extends from the block 48. The tab 50 is adapted to mate with the locating slot 34 of the beacon 18. The block 48 is removably secured to the second end 24 of the cavity 32.

The access window 26 is located proximate the second end 24. The access window 26 is located proximate a location where the beacon 18 abuts the clocking assembly 46. Preferably, the cover 28 is located proximate a location where the locating slot 34 abuts the locating tab 50. More preferably, the window 26 is machined through a wall of the housing and is approximately 1.5" wide by 4" in length. The cover 28 is machined to fit and secure the window 26.

The beacon 18 is "clocked" inside the housing 20 to a proper position. Preferably, the locating slot 34 engages the locating tab 50 when the beacon 18 is in a proper position. The engagement of the slot 34 and the tab 50 can be checked visually through the access cover 28. Preferably, the locating tab 50 may be rotated to position it in alignment with the drill bit 14 (FIG. 1). The beacon 18 and drill bit 14 are thus "calibrated" by orientation of the locating tab 50 of the clocking assembly 46 and the slot 34 of the beacon.

The housing is designed such that a number of beacons 18 can be installed into the same housing. Differing lengths of the beacon 18 can be addressed by installing a cylinder into the housing to fill any unneeded space. In one embodiment, the beacons 18 are wireless and transmit a signal from the housing 20 to the surface where a receiver (not shown) picks up the data. Wireless beacons are often battery powered. Preferably, the battery (not shown) of the beacon is positioned such that the battery may be removed and replaced using the access window 26. Alternatively, the beacon 18 can be operated and powered by a wireline (not shown) in the drill string 12 (FIG. 1). One skilled in the art will appreciate that a wireline will require a port to be provided in the housing 20 for passing the wireline through the drill string 12.

The beacon 18 may also comprise a heat sensor or temperature indicator. Preferably, the access window 26 is positioned to view these elements of the beacon 18 without physical removal of the beacon from the housing 20.

A problem existing in the art is the eventual migration of mud and dirt associated with the drilling process inside the housing 20 or the breakdown of epoxy proximate the beacon 18, compromising the ability to operate and handle the beacon. One skilled in the art will appreciate that the open first end 22 and the access window 26 located proximate the second end 24 of the housing allow for a pathway for flushing drilling mud or other undesirable material from cavity 32.

Although the preferred embodiment has been described in detail, it should be understood that various changes, substitutions and alterations can be made therein without departing from the spirit and scope of the invention as defined by the claims.

What is claimed is:

1. A system for drilling a borehole comprising:
- a rotary drill;
- a drill string operatively connected to the rotary drill;
- a housing comprising a tab connected at a downhole end of the drill string, the housing comprising a tubular body with a cavity and a window, the cavity having a first end and a second end;
- wherein the first end of the cavity defines an opening for loading a beacon comprising an indexing slot into the cavity;
- wherein the tab is engageable to the indexing slot and located proximate the second end of the cavity; and
- wherein the window allows access to the beacon from an exterior of the housing when the beacon is within the cavity.

2. The system of claim 1 wherein the window is 4 inches long by 1.5 inches wide.

3. The system of claim 1 further comprising an end plug engageable at the first end of the housing to close the opening.

4. The system of claim 3 wherein the end, plug comprises:
- a plug housing engageable with the housing;
- a bracket engageable with the beacon; and
- a spring extending between the plug housing and the bracket to bias the bracket away from the plug housing.

5. The system of claim 1 further comprising a removable window cover engageable to the housing to cover the window.

6. The system of claim 1 wherein the beacon comprises an orientation sensor and a transmitter.

7. A method for drilling a horizontal borehole using a drill string, a beacon and a drill bit, the method comprising:
- providing a housing to a downhole end of the drill string, the housing having a window and a cavity, the cavity having a first end and a second end;
- inserting the beacon into the cavity;
- abutting the beacon with the second end of the cavity;
- closing the first end of the cavity with an end plug comprising a spring for biasing the beacon toward the second end of the cavity; and
- visually verifying that the beacon has a desired orientation relative to the housing through the window.

8. The method of claim 7 further comprising closing the window.

9. The method of claim 7 wherein the beacon comprises a slot and wherein the housing comprises a tab, the method further comprising rotating the beacon within the cavity to align the tab to the slot.

10. The method of claim 9 further comprising orienting the tab to a known orientation of the drill bit.

11. The method of claim 10 further comprising sending an orientation signal from the beacon indicating the orientation of the housing.

12. The method of claim 7 further comprising advancing the drill string and rotating the drill bit.

13. The method of claim 7 further comprising flushing spoils from the cavity using a pathway from the first end to the window.

14. A beacon housing comprising:

an open first end;

a closed second end;

a cavity to support a beacon therein;

a window having an axial length less than a length of the cavity, wherein the window is disposed proximate the second end;

a tab disposed within the cavity to index the beacon at a desired orientation;

a removable window cover; and a removable end plug to close the open first end.

15. The beacon housing of claim 14 wherein the window is disposed so that the tab is visible within the cavity through the window.

16. The beacon housing of claim 14 wherein the beacon comprises an orientation sensor for tracking and transmitting an orientation of the beacon.

* * * * *